US010684001B1

(12) United States Patent
Beckman

(10) Patent No.: US 10,684,001 B1
(45) Date of Patent: Jun. 16, 2020

(54) DETACHABLE FLOOD LIGHT ASSEMBLY

(71) Applicant: Michael E. Beckman, Lebanon, TN (US)

(72) Inventor: Michael E. Beckman, Lebanon, TN (US)

( * ) Notice: Subject to any disclaimer, the term of this patent is extended or adjusted under 35 U.S.C. 154(b) by 0 days.

(21) Appl. No.: 16/533,896

(22) Filed: Aug. 7, 2019

Related U.S. Application Data

(60) Provisional application No. 62/715,620, filed on Aug. 7, 2018.

(51) Int. Cl.

| | |
|---|---|
| ***F21V 21/36*** | (2006.01) |
| ***F21V 21/088*** | (2006.01) |
| ***F21V 23/06*** | (2006.01) |
| ***F21S 8/04*** | (2006.01) |
| ***F21W 131/107*** | (2006.01) |

(52) U.S. Cl.
CPC ..... *F21V 21/36* (2013.01); *F21S 8/043* (2013.01); *F21S 8/046* (2013.01); *F21V 21/088* (2013.01); *F21V 23/06* (2013.01); *F21W 2131/107* (2013.01)

(58) Field of Classification Search
CPC ..... F21V 19/004; F21V 21/096; F21V 21/36; F21S 8/04; F21S 8/043; F21S 8/046
See application file for complete search history.

(56) References Cited

U.S. PATENT DOCUMENTS 3,706,882 A * 12/1972 Eby ..... B60Q 1/18 362/398
4,538,214 A * 8/1985 Fisher ..... F21V 21/096 362/147
5,203,621 A 4/1993 Weinmeister et al.
6,644,617 B2 * 11/2003 Pitlor ..... H02G 3/20 248/544
6,953,267 B1 10/2005 Cunningham
7,726,852 B2 * 6/2010 Sanoner ..... F21V 21/096 135/16
8,490,936 B2 7/2013 Rinck
8,608,353 B2 12/2013 Girard
8,851,717 B2 * 10/2014 Verbrugh ..... F21S 8/038 362/398
8,911,116 B2 12/2014 Blincoe et al.
9,151,453 B2 * 10/2015 Holland ..... F21K 9/20
9,318,886 B1 * 4/2016 Pate ..... H01R 11/30
(Continued)

OTHER PUBLICATIONS

Twin-Head White Outdoor Flood Light with Dusk-to-Dawn. Product listing [online]. © 2000-2019 Home Depot Product Authority, LLC. [retrieved on Jun. 6, 2019]. Retrieved from the Internet: <URL: https://www.homedepot.com/p/Commercial-Electric-Twin-Head-White-Outdoor-Flood-Light-with-Dusk-to-Dawn-TPAR-PC-WH/307535385?MERCH=REC-_-PIPHorizontal2_rr-_-307535380-_-307535385-_-N>.

(Continued)

*Primary Examiner* — Alexander K Garlen
(74) *Attorney, Agent, or Firm* — Cramer Patent & Design, PLLC; Aaron R. Cramer

(57) ABSTRACT

A detachable flood light assembly includes a security light and motion detection system having a central attachment arm with a twist locking mechanism securing the flood light to the arm. An extendable pole is in mechanical communication with the arm. At the distal end of the pole is a magnetic coupling which permits the detachable flood light assembly to be removably positioned upon a base which in turn is positioned upon a surface normally inaccessible to a user absent other means.

20 Claims, 4 Drawing Sheets

(56) References Cited

U.S. PATENT DOCUMENTS

| | | | | |
|---|---|---|---|---|
| 9,528,688 | B2 | 12/2016 | McConnell | |
| 9,822,939 | B2 | 11/2017 | Krause | |
| 9,970,544 | B2 | 5/2018 | Yamasaki et al. | |
| 10,236,627 | B1 * | 3/2019 | Krize | H01R 13/6205 |
| 2012/0081923 | A1 * | 4/2012 | Li | F21V 21/096 362/612 |
| 2012/0194069 | A1 * | 8/2012 | Wang | F21S 8/04 315/32 |
| 2013/0043781 | A1 * | 2/2013 | Wang | F21V 21/096 313/46 |
| 2015/0040363 | A1 * | 2/2015 | Carlen | B25J 5/007 29/283 |
| 2015/0311689 | A1 * | 10/2015 | Noh | H02G 3/305 362/147 |
| 2016/0025318 | A1 * | 1/2016 | Skergeth | F21S 8/06 362/217.17 |
| 2017/0023262 | A1 * | 1/2017 | Cimino | F21V 21/096 |

OTHER PUBLICATIONS

150 Watt Incandescent Floodlight Lampholcler Kit, Powder Coated Gray. Product listing [online]. © 1994-2019, W. W. Grainger, Inc. [retrieved on Jun. 6, 2019]. Retrieved from the Internet: https://www.grainger.com/product/TAYMAC-Incandescent-Outdoor-Lampholder-21A134.

DocaPole 6-24 Foot Extension Pole with Light Bulb Changer. Product listing [online]. Copyright © 2019 Docazoo. [retrieved on Jun. 6, 2019]. Retrieved from the Internet: <URL: https://www.docazoo.com/products/6-24-foot-docapole-light-bulb-changer-pole-high-ceiling-light-bulb-changer-extension-pole-extendable-light-bulb-changer-for-high-ceilings-and-recessed-lights-light-bulb-changer-telescopic-pole?gclid=Cj0KCQjw_r3nBRDxARIsAJlj1eEYkLUStA5Qu0QpW-PzQM_BWS8KZnCkmUvlaiEbRjQc7ZLkRbOlLv0aAqSUEALw_wcB>.

SKU: 77-608; Brand: Satco; Name: 77-608. Product listing [online]. Copyright © 2019 iqlighting.com. [retrieved on Jun. 6, 2019]. Retrieved from the Internet: <URL:https://www.iqlighting.com/satco-77-608-77-608.asp?gclid=Cj0KCQjw_r3nBRDxARIsAJljleHryikbjlhyvPzII0opKCwMoUgyZ2wku-HTEA8rcRyvGZzhilFLxsaAm4zEALw_wcB>.

Magbulb—World's First Magnetic Lightbulb Connector!Relaunch. Product listing [online]. © 2019 Kickstarter, PBC. [retrieved on Jun. 6, 2019]. Retrieved from the Internet: <URL: https://www.kickstarter.com/projects/864631672/550738411?ref=405206&token=3fa10ca4>.

* cited by examiner

DETACHABLE FLOOD LIGHT ASSEMBLY

RELATED APPLICATIONS

This application claims the benefit of U.S. Provisional Application No. 62/715,620, which was filed Aug. 7, 2018, the entire disclosures of which are incorporated herein by reference.

FIELD OF THE INVENTION

The present invention relates generally to an outdoor lighting assembly for a building that is capable of being removably detachable from ground level.

BACKGROUND OF THE INVENTION

Many businesses and homeowners turn to the use of security lighting to illuminate their property during night-time hours. Some of these lights may include motion detectors that automatically energize should motion be detected. However, whatever their configuration, such lights are almost always mounted as high off the ground as possible. From the minimum of approximately ten feet (10 ft.) for single story homes up to thirty feet (30 ft.) for triple stories.

As such, lamp replacement is a considerable task. The use of a multi-story extension ladder is often required. Others may turn to the use of a lamp replacement pole which screws out the burned-out lamp and replaces it with a new lamp. Unfortunately, the higher the fixture, the more difficult and dangerous it becomes. Additionally, should the fixtures require re-aiming, or if replacement/repair is required, the user is often forced to hire the simple job out, at great cost, due to the dangerous height. Accordingly, there exists a need for a means by which elevated light fixtures can be easily maintained without the disadvantages as described above. The use of the assembly provides for access, maintenance and repair of elevated lighting fixtures in a manner which is not only quick, easy, and effective, but safe as well.

SUMMARY OF THE INVENTION

The principles of the present invention provide for a detachable flood light assembly, comprising a base unit which is affixed to a horizontal structure in order to change a bulb. The base unit is a rectangular prism having a first side capable of being flush mounted to a horizontal structure and a second side that has a perimeter edge and a recess. The detachable flood light assembly also comprises a pair of clips which are fixedly mounted to an interior leading surface of the perimeter edge and projecting minimally into the recess. The detachable flood light assembly also comprises an electrical socket which is centrally located within the recess. The electrical socket is capable of being in electrical communication with a power supply with a plurality of base unit wiring. The electrical socket includes a cavity with three or more female electrical connectors and a matching number of male electrical connectors which engage the respective female electrical connectors.

The detachable flood light assembly also comprises a plurality of clip receivers which are located on a plurality of exterior surfaces of the first side of the removable unit. The clip receivers are oriented and numbered to accommodate the clips of the base unit. Each of the clips are capable of removable attachment to one of the clip receivers such that the removable unit is securely attached to the base unit. The removable unit is generally of a size and shape to enable a first side thereof to securely nest within the recess of the base unit.

The detachable flood light assembly also comprises an electrical connector which is located on a first side of the removable unit. The electrical connector is centrally located so as to align with the electrical socket of the base unit. The electrical connector is capable of providing a mechanical connection and an electrical connection to the electrical socket of the base unit when the removable unit is attached. The detachable flood light assembly also comprises a plurality of lamps which are located on a second side of the removable unit. Each of the lamps are capable of removably receiving the bulb therein and providing an electrical connection to the bulb when firmly seated.

The detachable flood light assembly also comprises a plurality of removable unit wiring which are located within the removable unit that provides an electrical communication between each of the lamps and the electrical connector. The second side of the removable unit is located on a flat area capable of securely receiving a suction cup at the distal end of a pole. The removable unit may be configured to be removably attached to the base unit wherein removal of the removable unit from the base unit does not sever, pinch, or otherwise damage any electrical connection.

The clips may be located on one or more short sides of the perimeter edge or the clips may be located on one or more long sides of the perimeter edge. The clips may be horizontally aligned in pairs and located at a center of the respective sides. The power supply may be a power supply of the building to which the detachable flood light assembly is attached. The bulb may be firmly seated in one of the lamps and the electrical connector of the removable unit is attached to the electrical socket of the base unit. The base unit wiring may be in electrical communication with the power supply and activation of the power supply provides power to the bulb, which then illuminates a desired location. The attracting poles of the magnets may be overcome by manual force.

Each of the lamps may be adjustably attached to the second side of the removable unit via a pivoting joint to enable a respective lamp to be positioned in an orbiting manner relative to the removable unit. Each of the lamps may be connected to the pivoting joint via at least one arm. The pivoting joint may offset each of the lamp from the removable unit. The removable unit wiring may run through the arm to reach a specific lamp. The removable unit wiring may also run along the arm to reach the specific lamp. The pole may have a plurality of pole segments of any specific length to enable an operator at ground surface to reach the removable unit of the detachable flood light assembly with the pole. The pole segments may be attachable portions of the pole or telescoping portions of the pole.

Once the suction cup is firmly attached to the flat area, a gentle downward force may be applied to the pole is suitable to detach the clips of the base unit from the clip receivers of the removable unit and is suitable to detach the electrical connector from the electrical socket, and thus fully remove the removable unit from the base unit. The removable unit may be attached to the suction cup of the pole. The operator may easily access each of the lamps to perform maintenance thereon or to replace the bulbs.

To replace the removable unit to the base unit, the operator may align the removable unit within the recess of the base unit to ensure that the electrical connector is seated within the electrical socket and the clips attach to the clip receivers. Once achieved, the suction cup may be removed from the flat area and the attachment of the clips to the clip receivers may be strong enough to enable this process to be achieved. The suction cup may be attached to the pole via a threaded coupling secured via a locking thumbscrew.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
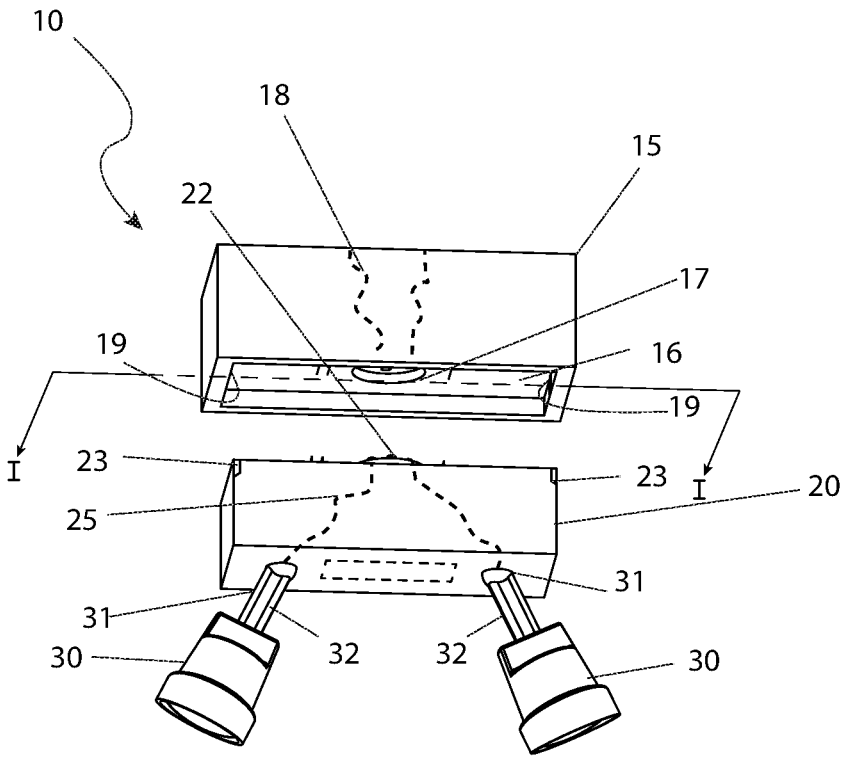
FIG. 1 is a bottom perspective view of the detachable flood light assembly 10, where the removable unit 20 is removed from the base unit 15, according to a preferred embodiment of the present invention; and, FIG. 2 is an environmental view of the detachable flood light assembly, showing an operator 100 in the process of addressing the assembly 10, according to the preferred embodiment of the present invention; and, FIG. 3 is a sectional view of the detachable flood light assembly 10, as seen along a line I-I, as shown in FIG. 1, according to the preferred embodiment of the present invention, and, FIG. 4 is a detailed view of the pole 40 and the suction cup 41, as used with the detachable flood light assembly 10, according to the preferred embodiment of the present invention.

10 detachable flood light assembly
15 base unit
16 recess
17 electrical socket
18 base unit wiring
19 clip
20 removable unit
22 electrical connector
23 clip receiver
25 removable unit wiring
28 flat area
30 lamp
31 pivoting joint
32 arm
40 pole
41 suction cup
42 pole segment
50 roof
55 eave
60 building
100 operator
110 ground
150 cavity
155 female electrical connectors
160 male electrical connectors
165 magnets
170 threaded coupling
175 locking thumbscrew
180 string
185 flange
190 travel path "d"

1. Description of the Invention

The best mode for carrying out the invention is presented in terms of its preferred embodiment, herein depicted within FIG. 1. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

The detachable flood light assembly (herein described as the "assembly" 10), allows an operator 100 who remains at ground surface 110 to safely and effectively remove a removable unit 20 from a base unit 15 that is affixed to an eave 55 of a roof 50 of a building 60 in order to change the bulbs inside a lamp 30.

The base unit 15 is capable of being affixed to a desired portion of an underneath surface of an eave 55 of a roof 50 of a building 60; although other locations are also possible due to where the illumination from the lamps 30 is desired to be directed. The base unit 15 is essentially a rectangular prism, having a first side capable of being flush mounted to a horizontal structure (such as the eave 55), and a second side that has a perimeter edge and a recess 16. However, the base unit 15 could also be a round square, ovular or any other suitable shape. At least two (2) clips 19 are fixedly mounted to an interior leading surface of the perimeter edge and projecting minimally into the recess 16. While this is the preferred embodiment, the at least two (2) clips 19 could be substituted for a pair of magnets. The clips 19 can be located on the short sides or the long sides of the perimeter edge or both and are preferably horizontally aligned in pairs and preferably located at a center of the respective sides. Centrally located within the recess 16 is an electrical socket 17. The electrical socket 17 is capable of being in electrical communication with a power supply with base unit wiring 18. Such a power supply is preferably the power supply of the building 60 to which the assembly 10 is attached. The power supply could be of the traditional electrical socket male/female plug or could also be an electric conductive magnet which could not only secure the detachable section to the base but could also be the electric current supplier.

The removable unit 20 is configured to be removably attached to the base unit 15. Removal of the removable unit 20 from the base unit 15 does not sever, pinch, or otherwise damage any electrical connection. The removable unit 20 is generally of a size and shape to enable a first side thereof to securely nest within the recess 16 of the base unit 15. Located on exterior surfaces of the first side of the removable unit 20, and oriented and numbered to accommodate the clips 19 of the base unit 15, are clip receivers 23. Each clip 19 is capable of removable attachment to an individual clip receiver 23 such that the removable unit 20 is securely attached to the base unit 19. Also located on the first side of the removable unit 20, centrally located so as to align with the electrical socket 17 of the base unit 15, is an electrical connector 22. The electrical connector 22 is capable of providing a mechanical and an electrical connection to the electrical socket 17 of the base unit 15 when the removable unit 20 is attached thereto. Further description of the electrical socket 17 and the electrical connector 22 will be provided herein below.

Located on the second side of the removable unit 20 is at least one (1) lamp 30. Each lamp 30 is capable of removably receiving a bulb therein and providing an electrical connection to the bulb when firmly seated therein. Each lamp 30 is adjustably attached to the second side of the removable unit 20 via a pivoting joint 31 to enable the respective lamp 30 to be positioned in an orbiting manner relative to the removable unit 20. Each lamp 30 is connected to the pivoting joint 31 via at least one (1) arm 32, which offsets the lamp 30 from the removable unit 20. Removable unit wiring 25 located within the removable unit 20 provides an electrical communication between each lamp 30 and the electrical connector 22. The removable unit wiring 25 may run through or along the arm 32 to reach the specific lamp 30. When a bulb is firmly seated in the lamp 30 and the electrical connector 22 of the removable unit 20 is attached to the electrical socket 17 of the base unit 15 and the base unit wiring 18 is in electrical communication with a power supply, activation of the power supply provides power to the bulb, which then illuminates the desired location.

Figure 2:
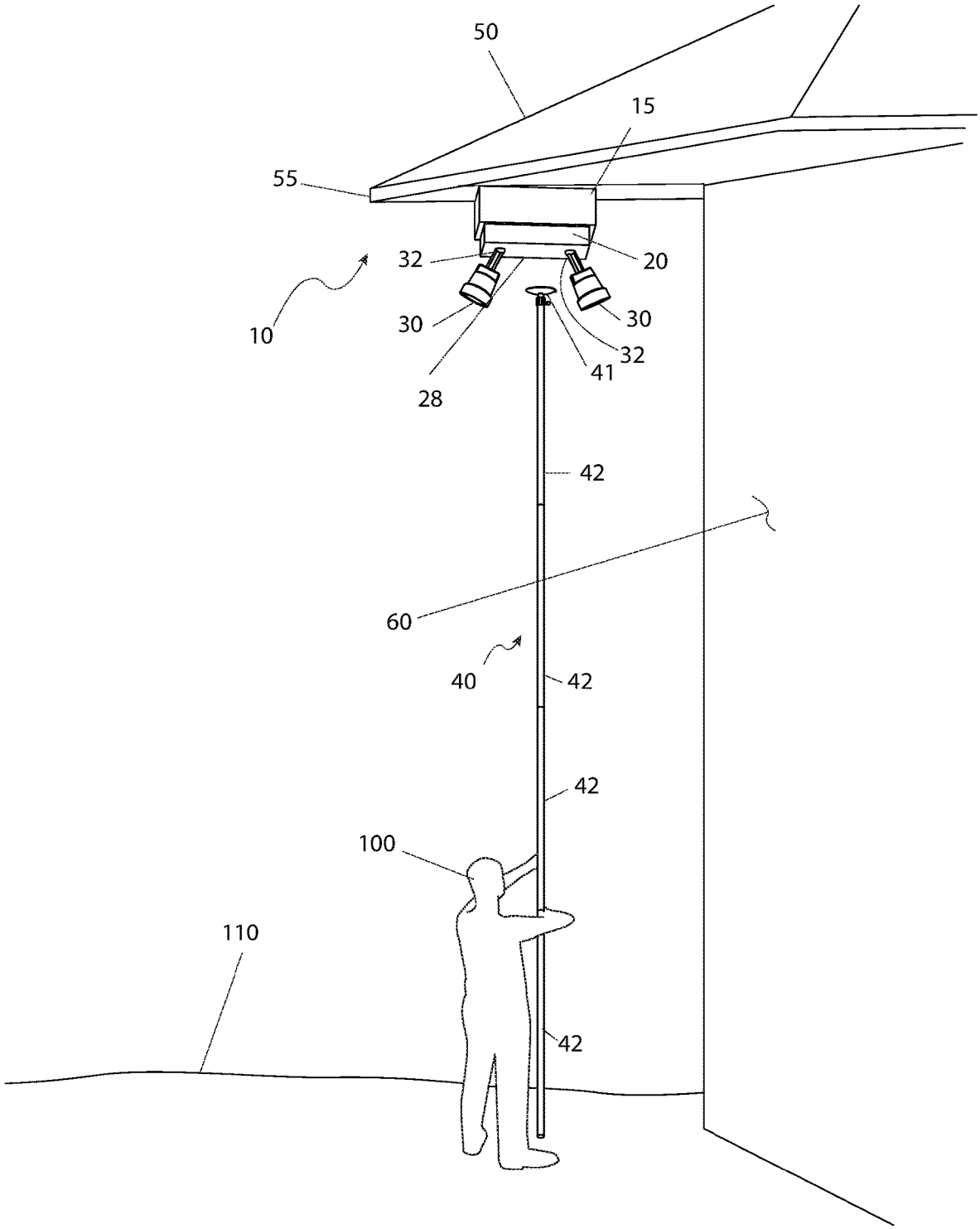

FIG. 2 is an environmental view of the assembly 10, showing an operator 100 in the process of addressing the assembly 10, according to the preferred embodiment of the present invention. Also located on the second side of the removable unit 20 and preferably in a central location is a flat area 28 capable of securely receiving a suction cup 41 at the distal end of a pole 40. The pole 40 may have a plurality of pole segments 42 of any specific length to enable an operator 100 at ground surface 110 to reach the removable unit 20 of the assembly 10 with the pole 40. The pole segments 42 can be attachable, or telescoping portions of the pole 40. Once the suction cup 41 is firmly attached to the flat area 28, a gentle downward force applied to the pole 40 is suitable to detach the clips 19 of the base unit 15 from the clip receivers 23 of the removable unit 20 and is suitable to detach the electrical connector 22 from the electrical socket 17, and thus fully remove the removable unit 20 from the base unit 20. From there, since the removable unit 20 is attached to the suction cup 41 of the pole 40, the operator 100 can easily access each lamp 30 to perform maintenance thereon or to replace bulbs. To replace the removable unit 20 to the base unit 15, the operator 100 aligns the removable unit 20 within the recess 16 of the base unit 15 to ensure that the electrical connector 22 is seated within the electrical socket 17 and the clips 19 attach to the clip receivers 23. Once achieved, the suction cup 41 is removed from the flat area 28 as described herein below. The attachment of the clips 19 to the clip receivers 23 are strong enough to enable this process to be achieved. The pole 40 may also comprise a threaded end or clip attachment in lieu of a suction cup.

An alternate embodiment is to have the lamps 30 affixed to the removable unit 20 in a fixed position instead of using the pivoting joints 31.

Figure 3:
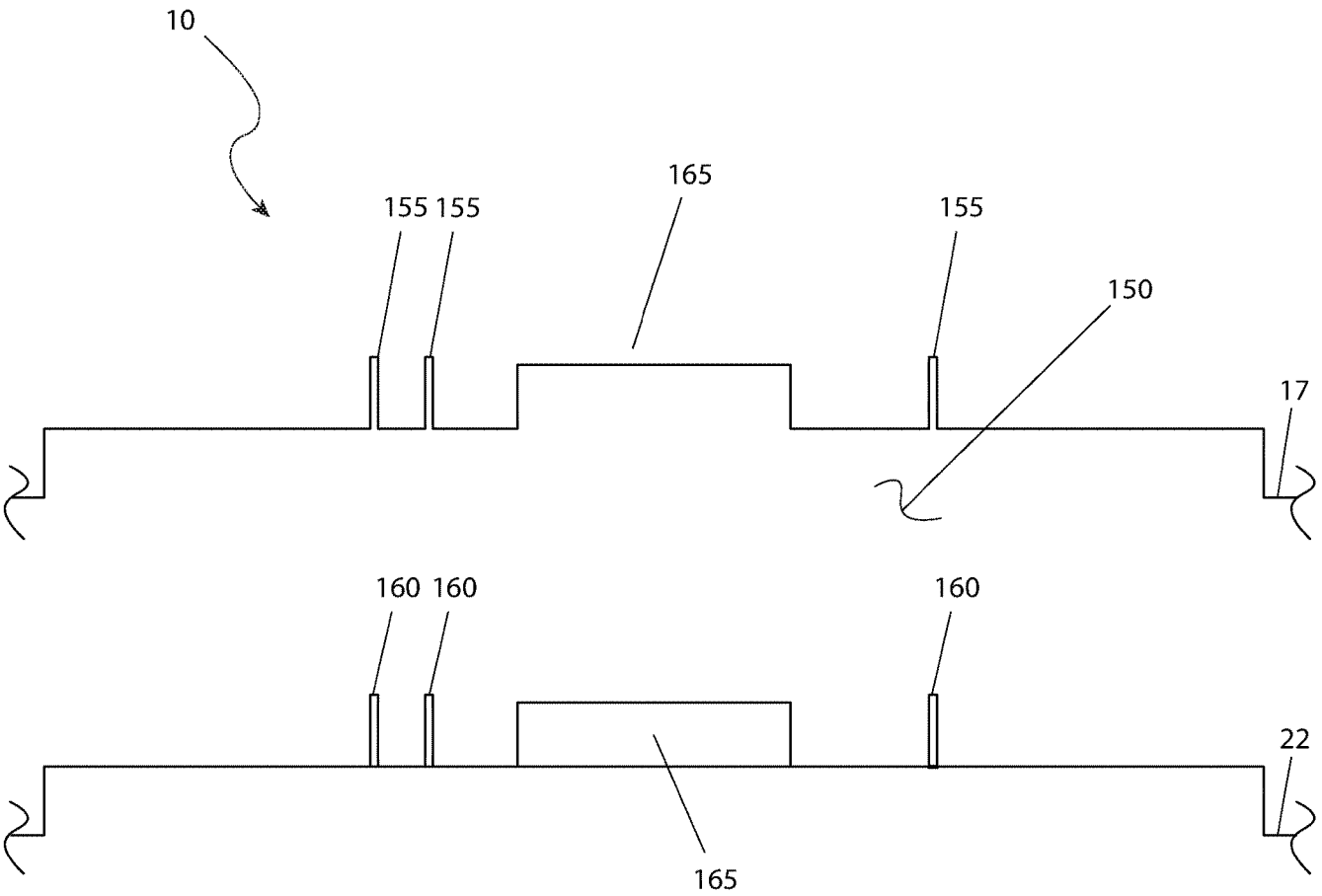

Referring now to FIG. 3, a sectional view of the detachable flood light assembly 10, as seen along a line I-I, as shown in FIG. 1, according to the preferred embodiment of the present invention is disclosed. This view provides further clarification on the electrical socket 17 and the electrical connector 22. The electrical socket 17 includes a cavity 150 with three (3) or more female electrical connectors 155. The minimum connections made include a hot, neutral and ground connection. Other connections for remote control, varying light output, and the like may be made as well. As such, the number of female electrical connectors 155 is not intended to be a limiting factor of the present invention. In a likewise manner, the electrical connector 22 is provided with a matching number of male electrical connectors 160, which engage the respective female electrical connectors 155. The female nature of the female electrical connectors ensures that no external non-grounded components are exposed where they would pose a shock hazard. To ensure alignment of the female electrical connectors 155 and the male electrical connectors 160, both the electrical socket 17 and the electrical connector 22 are provided with magnets 165, arranged with attracting poles facing one another. These magnets 165 provide for the self-alignment of the electrical socket 17 and the electrical connector 22, as well as to hold the base unit 15 and the removable unit 20 together. The attracting force of the magnets 165 can be overcome by manual force.

Figure 4:
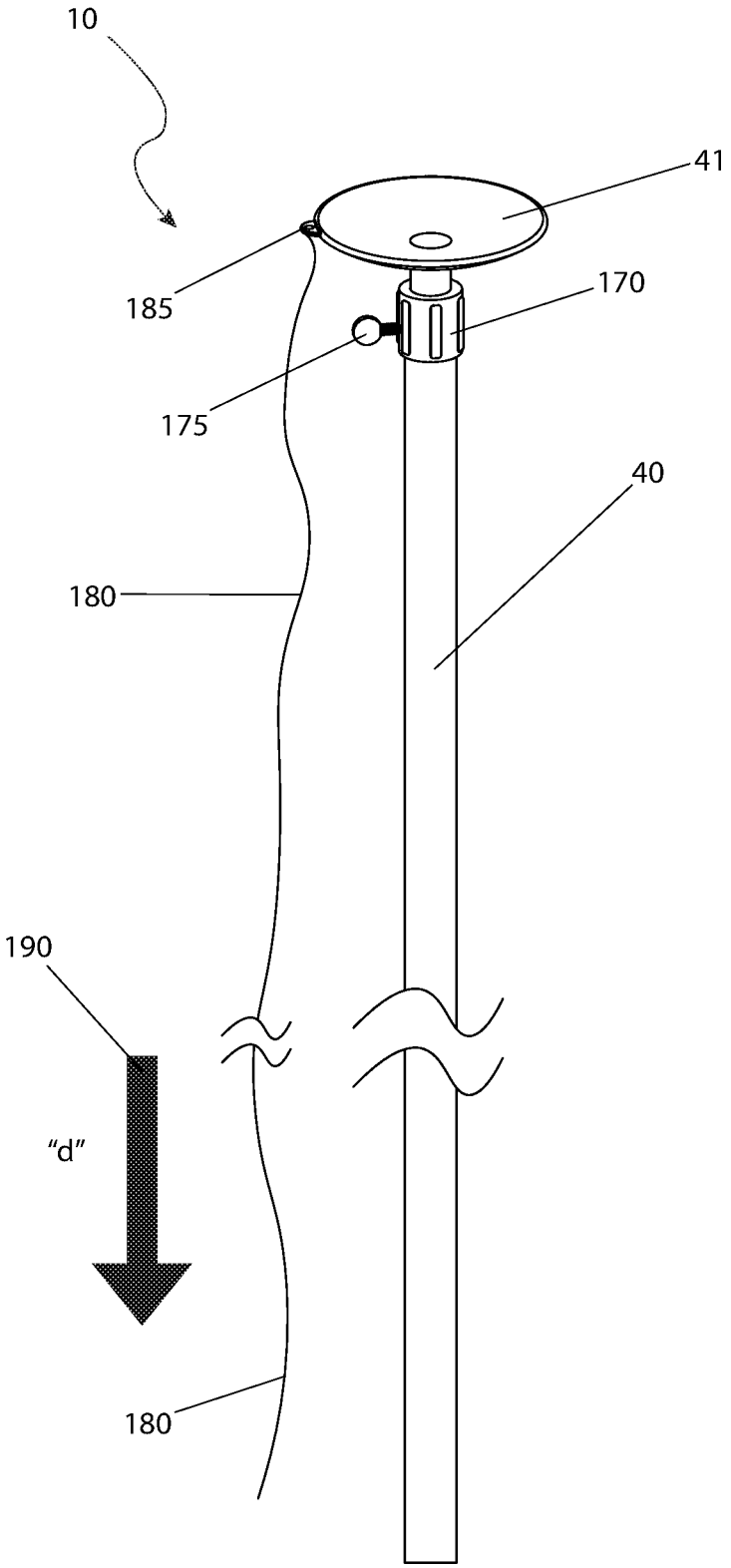

Referring to FIG. 4, a detailed view of the pole 40 and the suction cup 41, as used with the detachable flood light assembly 10, according to the preferred embodiment of the present invention is depicted. This view provides additional teachings on the operation of the suction cup 41. The suction cup is attached to the pole 40 via a threaded coupling 170 secured via a locking thumbscrew 175. In order to remove the suction cup 41 from the flat area 28 (as shown in FIG. 1), the operator 100 pulls downward on a string 180, along a travel path "d" 190 which is connected to a flange 185 on the rim of the suction cup 41. Such action breaks the vacuum seal of the suction cup 41 and allows the suction cup 41 to be removed while leaving the removable unit 20 (as shown in FIG. 1) engaged with the base unit 15 (as shown in FIG. 1).

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A detachable flood light assembly, comprising:

a base unit affixed to a horizontal structure in order to change a bulb, the base unit is a rectangular prism having a first side capable of being flush mounted to the horizontal structure and a second side that has a perimeter edge and a recess;

a pair of clips fixedly mounted to an interior leading surface of the perimeter edge and projecting minimally into the recess;

an electrical socket centrally located within the recess, the electrical socket is capable of being in electrical communication with a power supply with a plurality of base unit wiring, the electrical socket includes a cavity with three or more female electrical connectors and a matching number of male electrical connectors which engage the respective female electrical connectors;

a plurality of clip receivers located on a plurality of exterior surfaces of the first side of the removable unit, the clip receivers are oriented and numbered to accommodate the clips of the base unit, each of the clips are capable of removable attachment to one of the clip receivers such that the removable unit is securely attached to the base unit, the removable unit is generally of a size and shape to enable a first side thereof to securely nest within the recess of the base unit;

an electrical connector located on a first side of the removable unit, the electrical connector is centrally located so as to align with the electrical socket of the base unit, the electrical connector is capable of providing a mechanical connection and an electrical connection to the electrical socket of the base unit when the removable unit is attached thereto;

a plurality of lamps located on a second side of the removable unit, each of the lamps are capable of removably receiving the bulb therein and providing an electrical connection to the bulb when firmly seated therein;

a plurality of removable unit wiring located within the removable unit that provides an electrical communication between each of the lamps and the electrical connector;

wherein the second side of the removable unit is located on a flat area capable of securely receiving a suction cup at the distal end of a pole; and wherein the removable unit is configured to be removably attached to the base unit wherein removal of the removable unit from the base unit does not sever, pinch, or otherwise damage any electrical connection.

2. The detachable flood light assembly, according to claim 1, wherein the clips are located on one or more short sides of the perimeter edge.

3. The detachable flood light assembly, according to claim 1, wherein the clips are located on one or more long sides of the perimeter edge.

4. The detachable flood light assembly, according to claim 1, wherein the clips are horizontally aligned in pairs and located at a center of the respective sides.

5. The detachable flood light assembly, according to claim 1, wherein the power supply is a power supply of the building to which the detachable flood light assembly is attached.

6. The detachable flood light assembly, according to claim 1, wherein the bulb is firmly seated in one of the lamps and the electrical connector of the removable unit is attached to the electrical socket of the base unit.

7. The detachable flood light assembly, according to claim 1, wherein the base unit wiring is in electrical communication with the power supply and activation of the power supply provides power to the bulb, which then illuminates a desired location.

8. The detachable flood light assembly, according to claim 1, wherein the attracting poles of the magnets are overcome by manual force.

9. The detachable flood light assembly, according to claim 1, wherein each of the lamps are adjustably attached to the second side of the removable unit via a pivoting joint to enable a respective lamp to be positioned in an orbiting manner relative to the removable unit.

10. The detachable flood light assembly, according to claim 1, wherein each of the lamps are connected to the pivoting joint via at least one arm, the pivoting joint offsets each of the lamp from the removable unit.

11. The detachable flood light assembly, according to claim 1, wherein the removable unit wiring runs through the arm to reach a specific lamp.

12. The detachable flood light assembly, according to claim 11, wherein the removable unit wiring runs along the arm to reach the specific lamp.

13. The detachable flood light assembly, according to claim 1, wherein the pole has a plurality of pole segments of any specific length to enable an operator at ground surface to reach the removable unit of the detachable flood light assembly with the pole.

14. The detachable flood light assembly, according to claim 13, wherein the pole segments are attachable portions of the pole.

15. The detachable flood light assembly, according to claim 13, wherein the pole segments are telescoping portions of the pole.

16. The detachable flood light assembly, according to claim 1, wherein once the suction cup is firmly attached to the flat area, a gentle downward force applied to the pole is suitable to detach the clips of the base unit from the clip receivers of the removable unit and is suitable to detach the electrical connector from the electrical socket, and thus fully remove the removable unit from the base unit.

17. The detachable flood light assembly, according to claim 16, wherein the removable unit is attached to the suction cup of the pole, the operator easily accesses each of the lamps to perform maintenance thereon or to replace the bulbs.

18. The detachable flood light assembly, according to claim 1, wherein to replace the removable unit to the base unit, the operator aligns the removable unit within the recess of the base unit to ensure that the electrical connector is seated within the electrical socket and the clips attach to the clip receivers.

19. The detachable flood light assembly, according to claim 18, further comprising once achieved, the suction cup is removed from the flat area and the attachment of the clips to the clip receivers are strong enough to enable this process to be achieved.

20. The detachable flood light assembly, according to claim 1, wherein the suction cup is attached to the pole via a threaded coupling secured via a locking thumbscrew.

* * * * *